United States Patent [19]

Palmer

[11] 4,149,356

[45] Apr. 17, 1979

[54] METHOD AND APPARATUS FOR FILLING ENVELOPES WITH FINISHED DISC RECORDS AND STACKING THE FILLING ENVELOPES

[75] Inventor: Leonard Palmer, Morristown, N.J.

[73] Assignee: Lened, Inc., Elizabeth, N.J.

[21] Appl. No.: 893,119

[22] Filed: Apr. 4, 1978

[51] Int. Cl.[2] ..... B65B 43/28; B65B 43/36

[52] U.S. Cl. ..... 53/459; 53/501; 53/573; 53/385; 53/386

[58] Field of Search ..... 53/459, 469, 501, 157, 53/570, 571, 572, 573, 385, 386

[56] References Cited

U.S. PATENT DOCUMENTS

| | | | |
|---|---|---|---|
| 3,154,899 | 11/1964 | Burns | 53/572 X |
| 4,064,674 | 12/1977 | Palmer | 53/573 X |

*Primary Examiner*—Travis S. McGehee

*Attorney, Agent, or Firm*—Blum, Moscovitz, Friedman & Kaplan

[57] ABSTRACT

A method and apparatus for placing finished disc records in envelopes and stacking the thus-filled envelopes include pushing, by a suitable push pin, a finished record along a predetermined substantially straight path into an empty envelope which is held at the latter path by way of a releasable holding structure capable of being actuated to drop the filled envelope onto a stack of filled envelopes after each envelope receives a finished record. The empty envelopes are derived from a stack of empty envelopes situated beside the stack of filled envelopes. These stacks of empty and filled envelopes are arranged beside each other in a direction which is transverse with respect to the path along which each finished record is pushed. A supporting structure which carries the two stacks of envelopes is guided for movement transversely on the above path and is shifted laterally of the above path to successively locate the stacks respectively in a position beneath the structure which releasably holds the empty envelope at the above path. In this way when the empty stack of envelopes is situated at the latter position the releasable holding structure can engage and raise an empty envelope to the above path while when the stack of filled envelopes is then situated at the above position the releasable holding structure can be actuated to release a filled envelope to be dropped onto the stack of filled envelopes.

17 Claims, 6 Drawing Figures

METHOD AND APPARATUS FOR FILLING ENVELOPES WITH FINISHED DISC RECORDS AND STACKING THE FILLING ENVELOPES

BACKGROUND OF THE INVENTION

The present invention relates to a method and apparatus for placing finished disc records in envelopes and situating the envelopes with the disc records therein in a stack.

As is well known, as soon as the manufacture of disc records is completed, the finished records must be individually situated in envelopes, and the filled envelopes must then be arranged in a stack. At the present time the known methods and apparatus for enclosing the records within envelopes and arranging the envelopes within a stack are relatively complex and expensive. Furthermore, even though the known methods and apparatus are relatively complex and expensive nevertheless it is still required that a certain amount of manual operations be provided in connection with the placing of finished records in envelopes and the stacking of the filled envelopes.

For example, the finished records when placed in the envelopes immediately subsequent to the manufacture of the records are still warm and easily bendable so that they are easily warped. In order to avoid such warping metal separator plates are placed in the stack of filled envelopes separating the stack into groups of filled envelopes each of which includes a given number of filled envelopes. Thus, the metal separator plates will oppose the tendency of the records to warp immediately subsequent to the situation of the finished records in the envelopes. However, these separator plates are normally placed in the stack of filled envelopes manually so that undesirable labor costs are involved in these operations.

Moreover, the known relatively complex methods and apparatus for placing the records in the envelopes and stacking the filld envelopes not only involve complex designs which are easily subject to faulty operation, but in addition to a particular design is usually suited only for one type of record-manufacturing machine. Thus, each conventional record-manufacturing machine must at the present time be provided with its own unique structure for placing the finished records in envelopes and stacking the filled envelopes.

SUMMARY OF THE INVENTION

It is accordingly a primary object of the present invention to provide a method and apparatus which will avoid the above drawbacks.

In particular, it is an object of the present invention to provide a method and apparatus which is relatively simple and inexpensive as compared to known methods and apparatus for placing finished records in envelopes and stacking the filled envelopes.

In addition, it is an object of the present invention to provide a method and apparatus of the above type which can easily be adapted for use with different types of known record-manufacturing machines.

Furthermore, it is an object of the present invention to provide an apparatus which is capable of situating separator plates in the stack of filled envelopes in a fully automatic manner, thus avoiding manual operations in connection with the separator plates.

In addition, it is an object of the present invention to provide a method and apparatus of the above type which require only a relatively small amount of space.

Furthermore, it is an object of the present invention to provide a method and apparatus of the above type which are very reliable in operation, requiring the use of a relatively small amount of power, while at the same time achieving an extremely convenient system for placing the finished records in envelopes and stacking the filled envelopes.

According to the invention the finished records are pushed by a pusher means along a predetermined straight path, while a releaseable holding means holds an empty envelope in an open position at the above path to receive a record pushed along the path by the above pusher means. After a record is thus situated in an envelope the releasable holding means is actuated to drop the envelope with the record therein onto a stack of previously filled envelopes. The empty envelopes are derived from a stack of empty envelopes situated beside the stack of filled envelopes in a direction with respect thereto which is transverse with respect to the path along which each finished record is pushed by the pusher means. The releasable holding means is required only to move down to engage and raise an empty envelope from the stack of empty envelopes and thereafter when a record is situated in the empty envelope the releasable holding means will only be actuated to drop the empty envelope. The two stacks of envelopes are situated on a support means which is guided for movement transversely of the above path, and a shifting means moves the support means back and forth transversely of the above path to successively situate the stack of empty envelopes and the stack of filled envelopes at a position beneath the releasable holding means. Thus, when the stack of empty envelopes is situated at the above position the releasable holding means can raise the top empty envelope up to the path in a position for receiving a finished record, while when the stack of filled envelopes are situated at the above position the releasable holding means can be actuated to drop a filled envelope onto the stack.

BRIEF DESCRIPTION OF THE DRAWINGS

The invention is illustrated by way of example in the accompanying drawings which form part of this application and in which.

DESCRIPTION OF THE PREFERRED EMBODIMENTS

Figure 1:
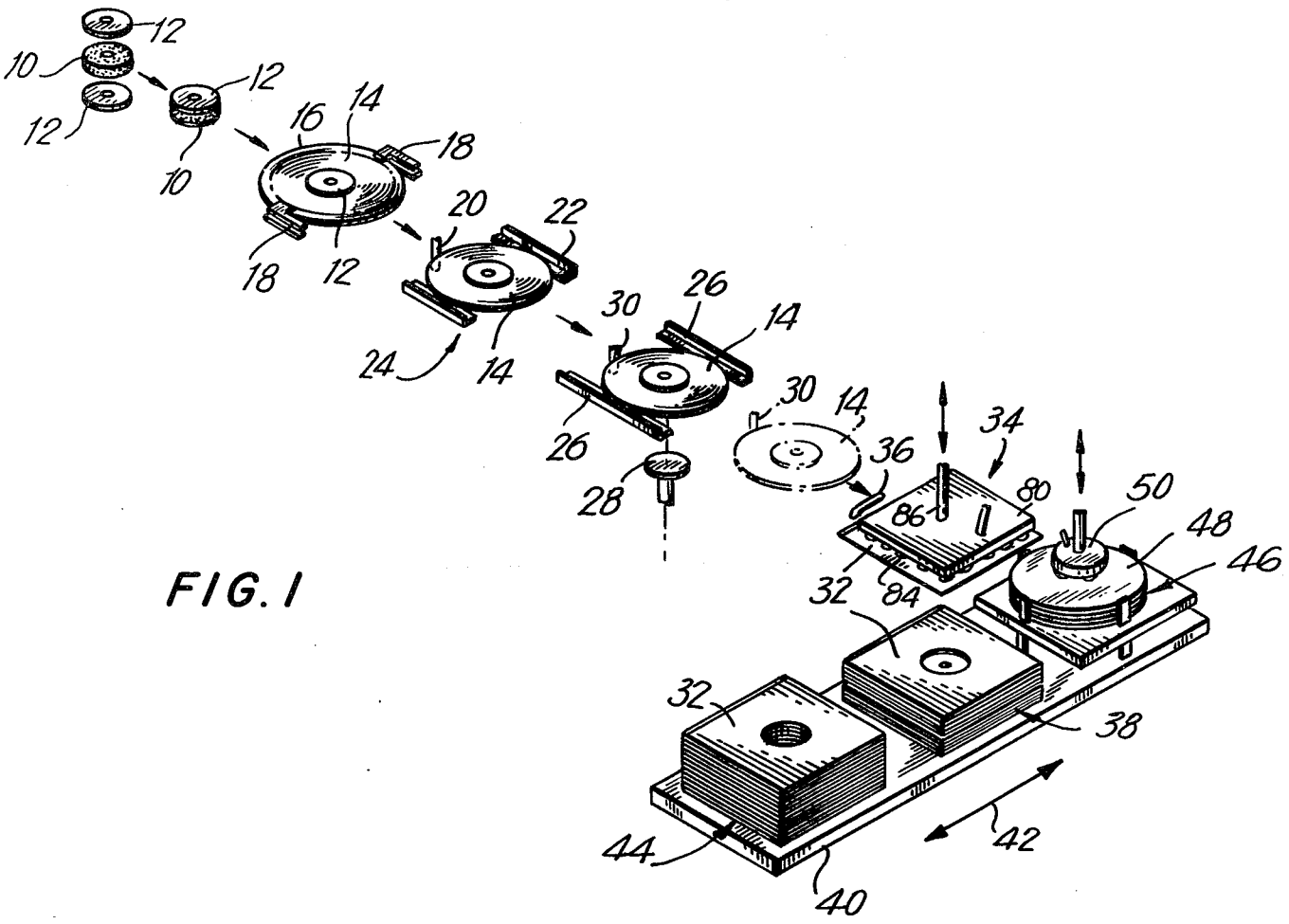
FIG. 1 is a schematic representation of a record-manufacturing machine and the structure and method of the present invention utilized therewith.

Referring to FIG. 1, there is schematically represented at the upper left thereof a cal 10 from which the record is subsequently formed, labels 12 being shown above and below the cake 10. The labels 12 are placed in engagement with the upper and lower surfaces of cake 10, whereupon this assembly is pressed in a known record press to form a disc record 14 which has a peripheral flash 16 to be removed therefrom, this flash being engaged in a known way by pairs of finger 18 which transport the record to the location where flash 16 is removed therefrom, whereupon the finished record is pushed as by a suitable pin 20 along guides 22 to the location 24 indicated in FIg. 1. The finished record 14 at the location 24 is then raised from this location and deposited on a pair of record guide rails 26 while supported by a circular plate 28 which is lowered to place the record 14 on the rails 26.

All of the structure preliminary to situating the finished record on the rails 26 is conventional and forms no part of the present invention. When a record 14 is thus situated on the rails 26 it is engaged by a pusher means which includes the schematically illustrated pusher pin 30, and this pusher pin 30 is advanced together with the record 14 in front of the same along a substantially straight path, the record 14 and pin 30 moving at this time through the positions thereof indicated in dot-dash lines in FIG. 1. along this predetermined substantially straight path of movement of the record 14 there is an open envelope 32 held at the path of movement of the record by way of a releasable holding means 34, the structure and method being such that the pin 30 pushes the finished record 14 into the envelope 32. The envelope 32 is maintained in its open position by a stream of air delivered to the interior of the envelope 32 by a blower means 36.

The envelope 32 is held by the releasable holding means 34 at the path of movement of the record 14 by a suction force applied by the releasable holding means 34 to the top surface of the envelope 32. Once the finished record is situated in the envelope 32, this suction is terminated so that the envelope 32 with the record 14 therein can drop. At this time there is situated beneath the releasable holding means 34 a stack 38 of envelopes 32 which are filled with records 14, so that each envelope with a record therein drops onto the stack 38.

This stack of filled envelopes 38 is supported by a support means 40 which is guided for movement back and forth transversely of this path of movement of the record 14 into the envelope 32, this transverse movement being indicated by the double-headed arrow 42 in FIG. 1. Thus, the parts are shown in FIG. 1 in a position where the stack 38 of filled envelopes is beneath the releasable holding means 34.

The support means 40 supports beside the stack 38 of filled envelopes, a stack 44 of empty envelopes so that the arrangement of the stacks 38 and 44 are such that they are situated one beside the other in a direction which is transverse with respect to the path of movement of each record 14 into each envelope 32. After each envelope 32 with a record therein is dropped onto the stack 38, the support means 40 is shifted toward the right, as viewed in FIG. 1, so as to locate the stack 44 of empty envelopes in a position previously occupied by the stack 38 of filled envelopes, this position being one where each of the stacks 38 and 44 are situated directly beneath the releasable holding means 34. When the stack 44 of empty envelopes is thus situated in the position previously occupied by the stack of filled envelopes, the releasable holding means 34 moves down to engage by the suction thereof the top envelope of the stack 44, raising this top envelope up to the path of movement of the record 14 in a position for receiving the next record. After each empty envelope is raised from the stack 44 the support means 40 is shifted back to the position where the filled stack 38 is situated beneath the releasable holding means 34 so that when the empty envelope receives a record it can drop with the record therein onto the stack 38. In this way a simple shifting of the stacks 38 and 44 back and forth as indicated by the arrow 42 it is possible for the releasable holding means 34, which is required only to move up and down, to raise an empty envelope from the stack 44 and drop an envelope with a record therein on the stack 38. From time to time an operator will remove filled envelopes from the stack 38 and will see to it that a supply of empty envelopes is maintained at the stack 44.

As has been indicated above, in order to oppose the tendency of the just finished records to warp while in the envelopes 32 at the stack 38, metal separator plates are situated in the stack 38 between the groups of filled envelopes, with each group including a given number of filled envelopes. According to a further feature of the invention, a stack 46 of circular metal separator plates 48 is situated on support means 40 at the side of the stack 38 opposite from the stack 44. The stack 46 of separator plates 48 is shown in FIG. 1 beneath a suction means 50 which can be lowered and raised in order to engage the top plate 48 and by suction raise the same from the stack 46. This suction means 50 also remains at the location shown in FIG. 1 and need only move up and down as indicated by the double-headed arrow shown in FIG. 1 above the suction means 50. The stack 38 of filled envelopes is shown in FIG. 1 in the position beneath the releasable holding means 34 for receiving the next envelope which has a record 14 situated therein. When the stack 44 of empty envelopes is then shifted to the position beneath the releasable holding means 34 previously occupied by the stack 38 of filled envelopes, this stack 38 of filld envelopes is shifted to a second position situated beneath the suction means 50, this second position being occupied by the suction means 50, this second position being occupied by the stack 46 of plates 48 when the stack 38 of filled records is situated in the position beneath the releasable holding means 34. Thus, when the suction means 50 is raised with the top plate 48 from the stack 46, the movement of the stack 44 of empty envelopes to the position beneath the releasable holding means 34 will locate the stack of filled envelopes 38 beneath the suction means 59 which can bhen be actuated to release its suction so that a plate 48 will then drop onto the stack 38 of filled envelopes. As will be apparent from the description below the pusher means which includes the pin 30 also serves to actuate a counter which counts each time an envelope 32 with a record 14 therein dropped onto the stack 38. After a given number of envelopes with records therein is thus counted, a signal is transmitted to the suction means 50 in order to cause the latter to raise a plate 48 and hold it in a position to be dropped onto the stack 38 when the latter becomes situated at the above second position beneath the suction means 50.

It is thus apparent that with the above relatively simple method and apparatus it is possible to place records in envelopes, stack the filled envelopes, and locate separator plates in the stack of filled envelopes. The only manual operations are required in connection with removing filled envelopes from time to time from the stack 38, maintaining a supply of empty envelopes at the stack 44, and maintaining a supply of plates 48 at the stack 46. It will be noted that according to the method and apparatus of the invention the placing of records in the envelopes and the formation of the stack 38 goes forward without requiring any interruption for situating the separator plates 48 in the stack 38. Thus while the stack 44 is shifted to the position beneath the releasable holding means 34 and an empty envelope is raised from the stack 44 to the path of movement of the record 14 the operations in connection with situating a separator plate 48 in the stack 38 are going forward. Moveover, these operations require nothing beyond the movement which in any event is required for the stacks 38 and 44.

Figure 2:
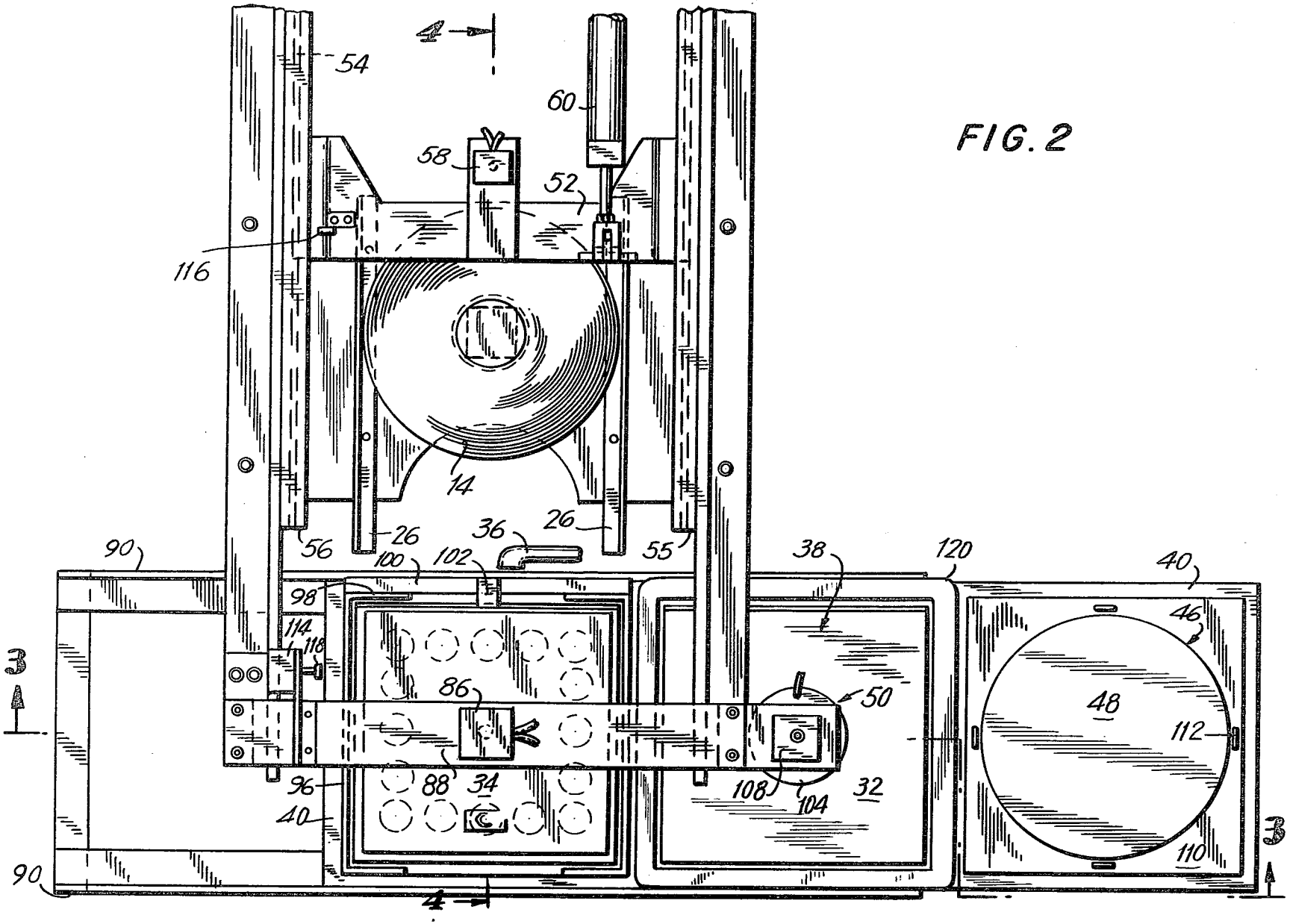
FIG. 2 is a top plan view of one possible apparatus of the invention for carrying out the method of the invention.
Figure 3:
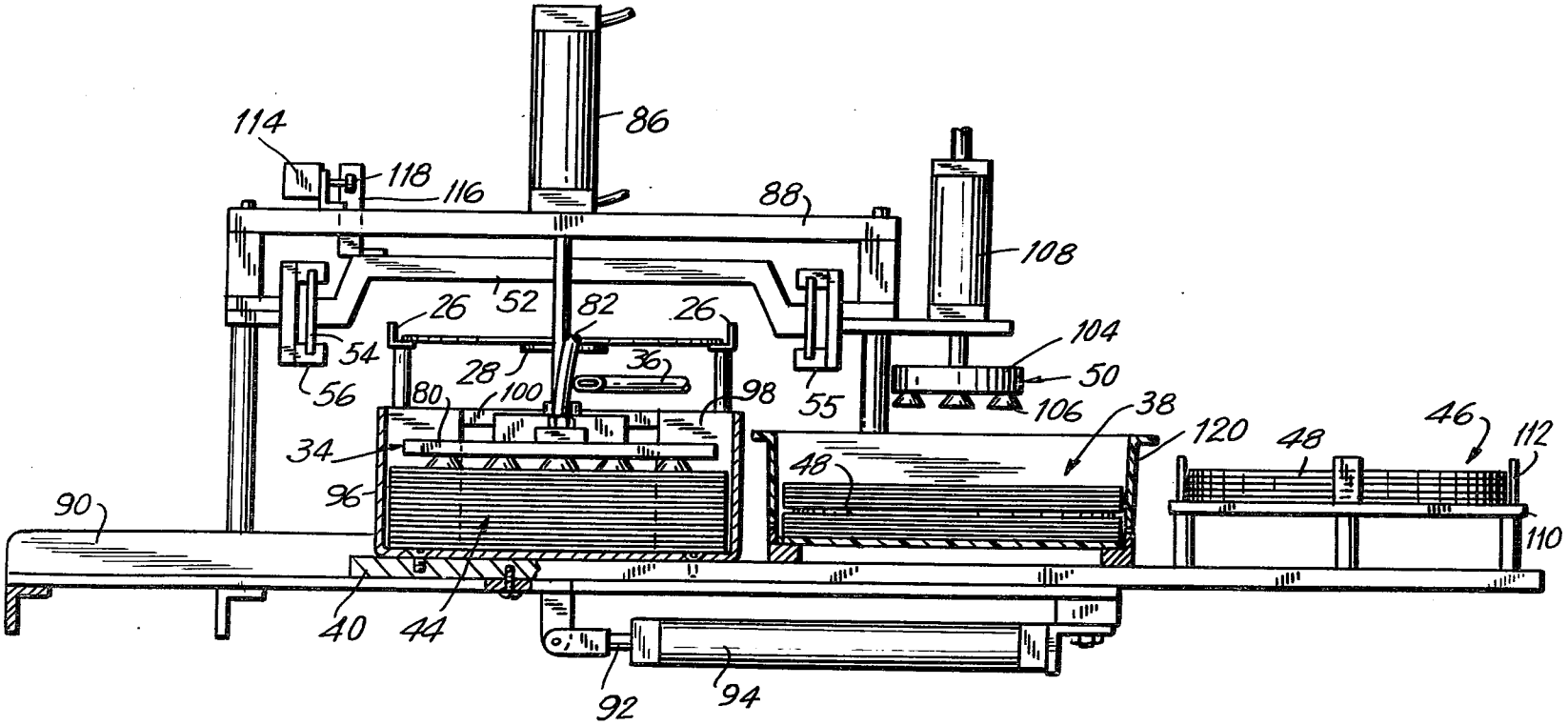
FIG. 3 is a transverse sectional elevation of the structure of FIG. 2 taken along line 3—3 in the direction of the arrows.
Figure 4:
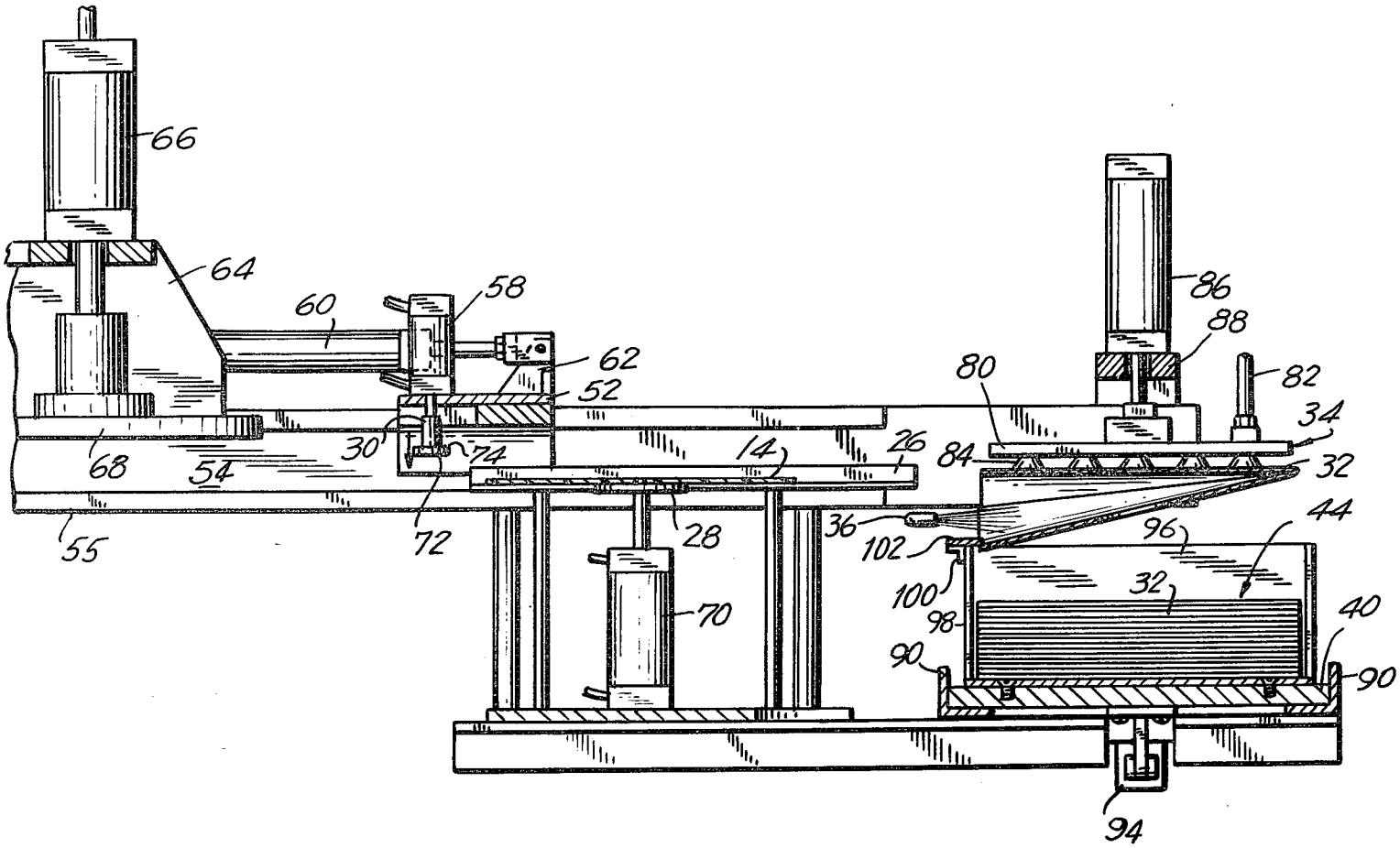
FIG. 4 is a longitudinal sectional elevation of the structure of FIG. 2 taken along line 4—4 in the direction of the arrows.

Referring now to the FIGS. 2–4, the pusher means which includes the pin 30 also includes a carriage or bridge 52 which extends transversely with respect to the path of movement of the record 14 and which at its ends is fixed to a pair of rails 54 guided for movement in longitudinally extended guides 56 supported as illustrated by a suitable frame structure. The carriage 52 fixedly carries a pneumatic cylinder-piston assembly 58, which has its piston rod extending through an opening in the bridge 52 and fixed at its lower end to the pin 30, as indicated in FIG. 4. A pneumatic piston-and-cylinder assembly 60 has its piston connected to a projection 62 fixed to an extending upwardly from the carriage 52 at one side thereof, and the piston of the assembly 60 is actuated so as to move the carriage or bridge 52 back and forth between positions indicated in FIGS. 4 and 6. The rails 54 also fixedly carry in any unillustrated manner a bridge or carriage 64 which carries a pneumatic piston-cylinder assembly 66, the piston rod of which fixedly carries a suction plate 68. Thus these carriages 64 and 52 move together back and forth to the right and left as viewed in FIGS. 4 and 6. When a finished record has reached the position 24 shown in FIG. 2, the suction plate or head 68 is situated over the record 14 and raises the latter from the location 24, the suchtion head 68 being moved downwardly for this purpose when at the location 24. The raised suction head 68 with the record 14 adhering thereto is then moved to the position shown in FIG. 6, to be situated over the plate 28. This plate 28 is fixed to the top end of the piston rod of a pneumatic piston-and-cylinder assembly 70 carried by the framework of the machine. When the suction head 68 is situated at the position of FIG. 6, the plate 28 is raised to engage the record 14 at the lower surface thereof, and then the suction in head 68 is released so that the plate 28 can then be lowered by actuation of the assembly 70, and thus the record 14 will be deposited on the rails 26 which are also supported by the framework of the machine. Then with the pusher pin 30 in an elevated position, the carriages 52 and 64 are returned to the position of FIG. 4, whereupon the pin 30 is lowered to the elevation of the record 14 which is now on the rails 26 and at the same time the suction head 68 is lowered to engage the next record at the location 24. At this time the assembly 60 is actuated to return the parts of the position of FIG. 6. The pin 30 is now in its lower position for engaging the record 14 at its trailing end and advancing the record 14 to the right, as viewed in FIGS. 4 and 6, along and beyond the rails 26 along the predetermined substantially straight path of movement of the record 14. Of course, at this time the plate 28 is lowered beyond the record which is retained by the rails 26.

It will be noted that the pin 30 has at its lower end an enlarged portion 72 which serves to provide the pin 30 with an upwardly directed shoulder 74. When the pin 30 engages the record 14 at its trailing end, the shoulder 74 is situated next to the lower surface of the record 14, so that while the record 14 is pushed by the pin 30 it is also supported thereby.

The releasable holding means 34 includes a hollow plate 80 having its hollow interior communicating through a flexible tube 82 with a source of suction which can be turned on and off by way of a suitable valve which controls the flow of air through the tube 82. The bottom wall of the hollow plate 80 carries a plurality of suction cups 84 which have their interiors communicating with the interior of the hollow plate 80 so that the suction can be applied to the interior cups 84. The plate 80 is carried by the bottom end of a piston rod of pneumatic cylinder piston assembly 86 which is mounted on a transverse bridge 88 carried at both ends by the frame structure of the machine, the bridge 88 being formed with an opening through which the piston rod of the pneumatic means 86 extends, as indicated in FIG. 4.

The support means 40 is in the form of a plate which is guided by a support guide means formed by a pair of angle irons 90 which extend transversely with respect to the path along which the record 14 moves, these guide rails 90 being supported by the frame structure of the machine. The plate 40 fixedly carries a downwardly extending lug which is pivotally connected to one end of a piston rod 92. The piston connected to the piston rod 92 is capable of reciprocating in a cylinder 94 which is fixedly carried by the frame structure of the machine in the manner shown in FIGS. 3 and 5. The flow of compressed air to and from the cylinder 94 is controlled so that the plate 40 will reciprocate back and forth along the guide rails 90 between the positions shown in FIGS. 3 and 5.

Figure 5:
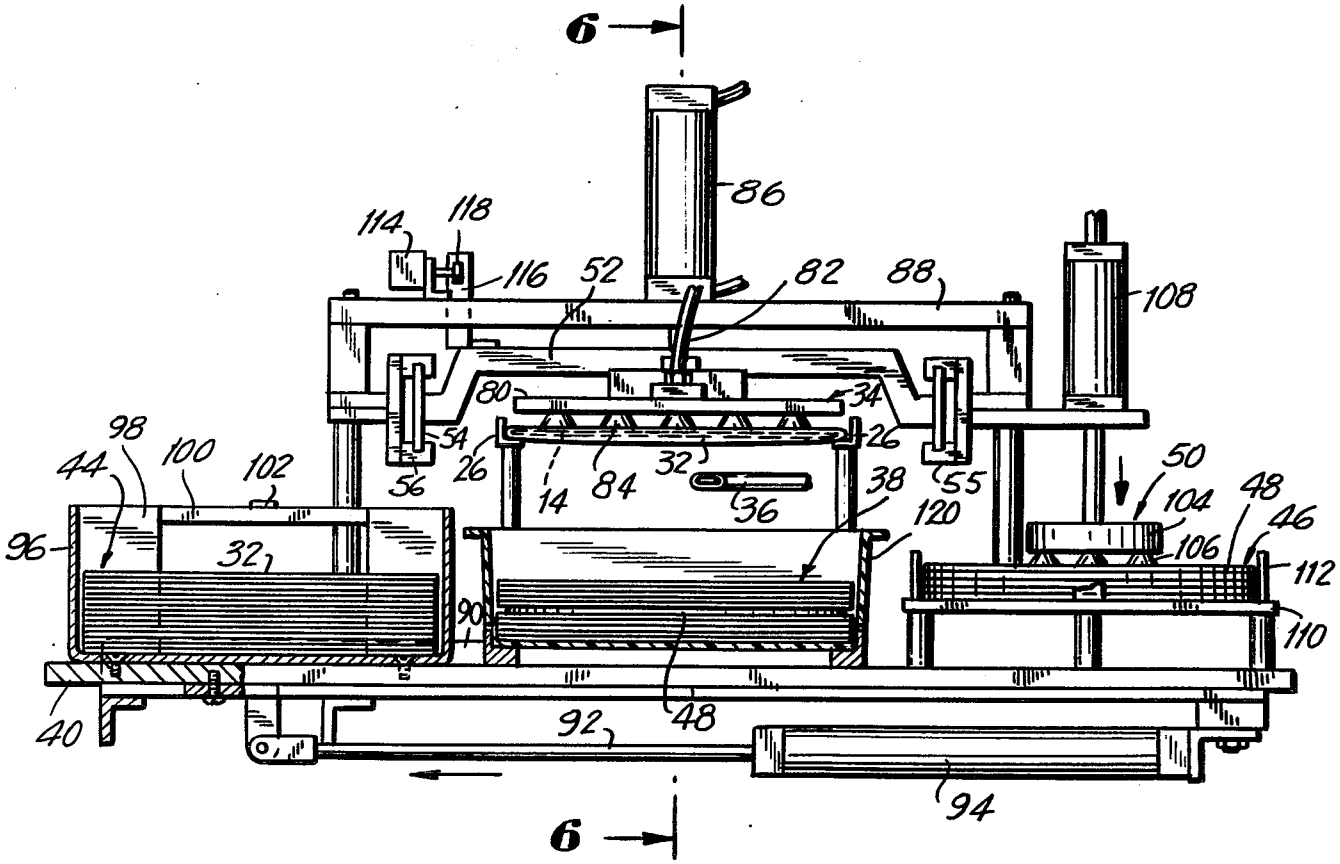
FIG. 5 shows the structure of FIG. 3 in a position different from that of FIG. 3.

The support means 40 fixedly carries at its left end region, as viewed in FIG. 5, a tray 96 in which the stack 44 of empty envelopes 32 is situated. The tray 96 has a front wall 98 which has a central open portion, and the tray 96 fixedly carries a horizontal bar 100 which extends across the opening in wall 98 at an upper end portion thereof in a manner apparent from FIGS. 4 and 5. The bar 100 fixedly carries at a central portion thereof a finger 102 which projects inwardly over the front edge regions of the envelopes 32 of the stack 44.

When the support means 40 is in the position shown in FIG. 3, the pneumatic means 86 is operated to lower the releasable holding means 34, and suction is supplied through the tube 82 so that the suction cups will engage the upper wall of the upper envelope of the stack 44, whereupon the pneumatic means 86 is operated to raise the envelope in the manner indicated in FIG. 4 The front edge region of the lower wall of each envelope extends forwardly beyond the front edge region of the upper wall thereof, and this lower wall is engaged by the finger 102 in the manner shown in FIG. 4, so that when the releasable holding means 34 raises each envelope up to the path of movement of the record 14, the envelope is in an open condition. The arrangement is such that the lower wall of each raised envelope will be held by finger 102. However, a supply of air delivered through the blower tube 36 blows into the open interior of the envelope 32 in order to maintain the latter in its open condition even it the lower wall of each envelope should happen to move upwardly beyond the finger 102. Thus while the upward movement of each envelope by the releasable holding means 34 will cause each envelope to be opened by the finger 102, nevertheless the continued upward movement of each envelope to the elevation of the path movement of the record 14 may displace the lower wall of each envelope upwardly beyond the finger 102 while each envelope will, if necessary, be maintained open by the flowing of air into the interior of the envelope from the tube 36.

Figure 6:
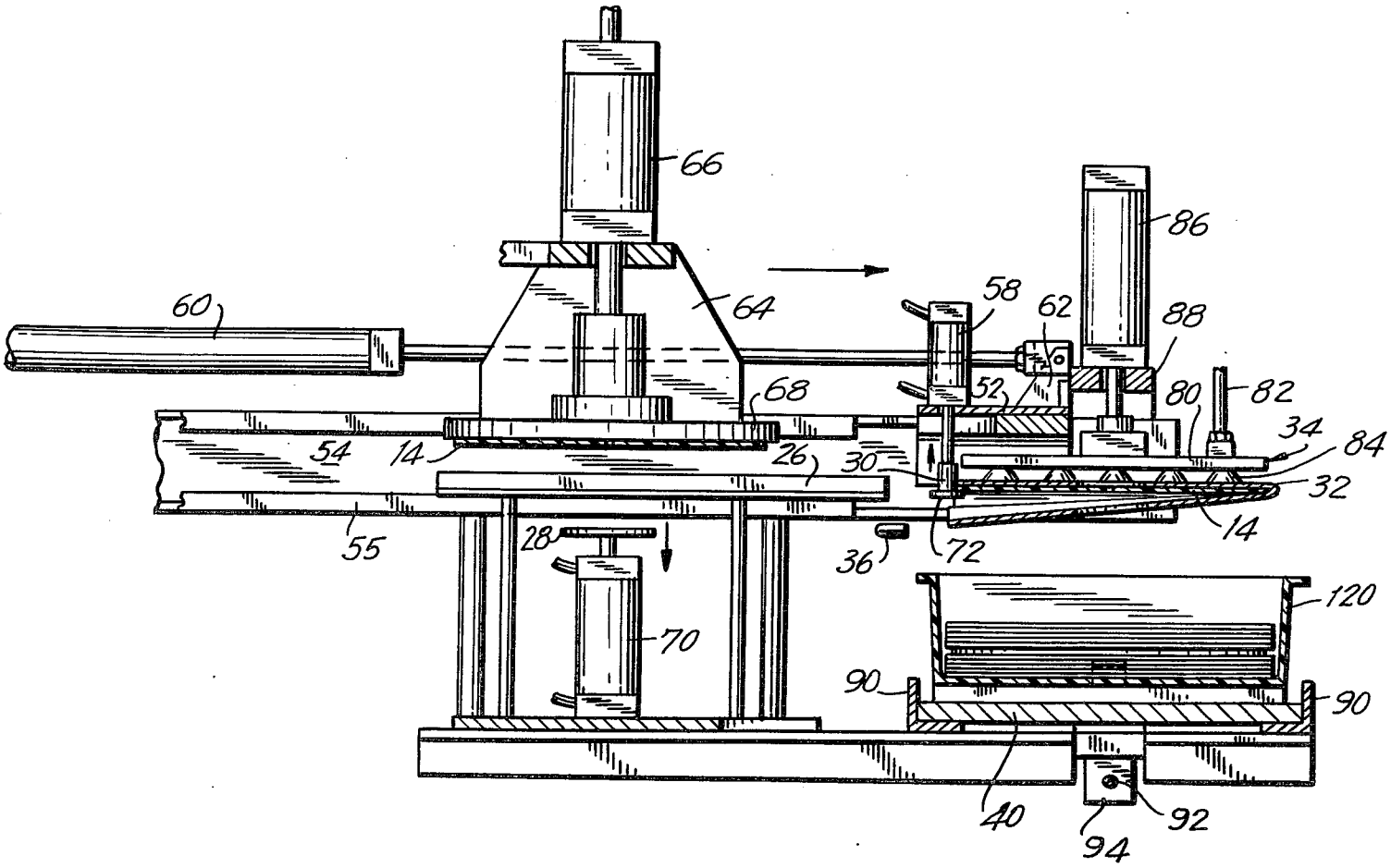
FIG. 6 shows the structure of FIG. 4 in a position different from that of FIG. 4.

A record will of course be inserted into each envelope in the manner described above. During this placement of each record into an envelope, the support means 40 is displaced from the position of FIG. 3 and into the position of FIG. 5 by way of pneumatic means 94. At this time the parts have the position as shown in FIGS. 5 and 6. When the pusher 30 reaches the position shown in FIG. 6, it starts to return back to the position shown in FIG. 4, with the pneumatic means 58 first raising the pusher 30 so that it will be situated over a record 14 deposited on the rails 26 while moveing back across this record to reach the position shown in FIG. 4. At the same time as the pusher 30 moves back to the suction in the tube 82 is terminated so that an envelope with the record therein then falls onto the stack 38 which is now in the position shown in FIG. 5. The flow through the tube 36 can be turned on and off in an automatic manner to assure that each envelope is maintained in its open position for receiving the record, or if desired a continuous flow of air may be delivered through the tube 36.

The suction means 50 is carried by the frame structure of the machine at a location over the stack 38 of filled envelopes when the support means is in the position shown in FIG. 3. This suction means 50 includes also a hollow suction head 104 with which a plurality of suction cups 106 communicate, the interior of the suction head 104 communicating with a source of suction through a flexible tube similar to the tube 82 and not illustrated in the drawings. The suction head 104 is carried by a piston rod of a cylinder-piston assembly 108 which may be pneumatic and which serves to lower and raise the suction head 104 between the positions shown in FIGS. 3 and 5.

At the side of the stack 38 opposite from the stack 44, the support means 40 fixedly carries a platform 110 on which the stack 46 of separator plates 48 is situated. A number of vertical fingers 112 extend upwardly from the platform 110 to be situated adjacent but beyond the outer peripheral edges of the separator plates 48.

When a separator plate is to be situated in tack 38, a signal is transmitted to the pneumatic means 108 so as to actuate the latter to lower the suction head 104 for engaging the upper separator 48 in the manner shown in FIG. 5, this operation taking place when the stack 38 of filled envelopes is in the position beneath the releasable holding means 34. Before the support means 40 is shifted by the pneumatic means 94 from the position of FIG. 5 into the position of FIG. 3 the suction head 50 is raised from the position of FIG. 5 to the elevation shown in FIG. 3, and now a separator plate will be held over the stack 38 when it reaches the position shown in FIG. 3, whereupon the interior of the suction head 104 is placed in communication with the outer atmosphere so that a support plate will now drop onto the stack 38.

The signal is transmitted to the pneumatic means 108 from a counter 114 which is fixedly carried by the bridge 88 in the manner apparent from FIGS. 2 and 3. The pusher means fixedly carries at its bridge 52 a finger 116 which engages the counter means 114 to actuate the same at each time a record is introduced into an envelope. Thus, at the end of the movement of the record 14 into an envelope 32, the finger 116 actuates an element 118 of a microswitch which forms part of the counter 114. Each time the microswitch is actuated the counter will respond so that the number of records introduced into envelopes is counted. After a given number of records have been introduced, such as, for example, five records, the counter 114 will respond to transmit to the pneumatic means 108 the signal for bringing about the placing of a separator plate onto the stack 38 as described above.

Thus it is apparent that with the above structure of the invention it is possible to carry out the method of the invention in the manner set forth in connection with FIG. 1.

The stack 38 of filled envelopes 32 is contained within a tray 120 which is fixedly carried by the support means 40 at the location apparent from FIGS. 2 and 3.

What is claimed is:

1. In a method for enclosing finished disc records in envelopes, respectively, and arranging the envelopes with the finished records respectively therein in a stack, the steps of pushing a finished record along a substantially straight path, holding an envelope in an open position at said path to receive in its interior the record which is pushed along said path, so that the record thus becomes enclosed within the envelope, depositing the envelope with the record therein onto a stack of filled envelopes which already have records respectively situated therein, then pushing a second record along said path while holding a second envelope in an open position at said path to receive the second record, and so on, and deriving empty envelopes to be successively situated at said path from a stack of empty envelopes situtated laterally beside the stack of filled envelopes in direction which is transverse to said path.

2. In a method as recited in claim 1 and including the steps of laterally shifting the stacks of empty and filled envelopes respectively to a position where each tack is situated in line with the said path but beneath the latter, raising an empty envelope from the top of the stack of empty envelopes to the elevation of said path when the stack of empty envelopes is in said position, for situating an empty envelope at said path to receive a record pushed along said path, then shifting the stack of empty envelopes laterally away from said position while simultaneously shifting the stack of filled envelopes in said position, then depositing an envelope with the record therein on the stack of filled envelopes which are at said position and shifting the stack of filled envelopes away from said position to again situate the stack of empty envelopes at said position and so on.

3. In a method as recited in claim 2 and wherein each envelope has a lower front edge situated forwardly of an upper front edge thereof, and including the step of preventing the lower front edge of each envelope from moving upwardly with the upper front edge thereof during the raising of each envelope into said path to receive a record, so that each envelope is automatically opened as it is elevated up to said path to receive a record.

4. In a method as recited in claim 3 and including the step of blowing a stream of air into the interior of each envelope after it is opened in order to maintain it open for receiving the record.

5. In a method as recited in claim 2 and including the step of placing a separator plate on each of a given number of filled envelopes in the stack of filled envelopes when the latter stack of filled envelopes will include groups of filled envelopes each including said given number of filled envelopes and separated from each other by said separator plates, the placing of each separator plate being carried out simultaneously with the operations in connection with the raising of an empty envelope to said path.

6. In a method as cited in claim 5 and including the step of deriving each separator plate from a stack of separator plates situated laterally beside the stack of filled envelopes at a side of the stack of filled envelopes opposite from the stack of empty envelopes.

7. In a method as recited in claim 6 and wherein the position into which the stack of empty envelopes and stack of filled envelopes are shifted in alignment with but beneath said path is a first position to receive a separator plate while said empty envelopes are in said first position, and including the steps of shifting the stack of separator plates into said second position simultaneously with the shifting of said stack of filled envelopes into said first position, and after said given number of filled envelopes have been located at the stack of filled envelopes raising a separator plate from the top of the stack of separator plates while the latter stack is at second position while the stack of filled envelopes is shifted from said first to said second position, and then depositing the raised separator plate onto the stack of filled envelopes while the latter is at said second position.

8. In a method as recited in claim 1 and wherein each record has leading and trailing ends with respect to its direction of movement along said path into an envelope, and pushing each record along the said path by engaging each record at its trailing end while simultaneously supporting each record at a lower surface region thereof situated at its trailing end so that simultaneously with the pushing of each record into an envelope each record is supported at its trailing end.

9. In an apparatus for enclosing disc records in envelopes and arranging the envelopes with records respectively therein in a stack, record guide means for guiding a finished record for movement along a predetermined substantially straight path, pusher means for engaging and pushing a finished record along said path, releasable holding means for releasably holding an empty envelope is an open position at said path by said pusher means, support means for supporting a stack of empty envelopes and a stack of filled envelopes respectively at locations situated beside each other transversely but beneath said path, said releasable holding means and said support means forming a pair of means, and shifting means operatively connected with one of said pair of means for shifting said one means with respect to the other of said pair of means transversely with respect to said path in a manner according to which said releasable holding means is alternately over said stack of filled envelopes and over said stack of empty envelopes, so that when the holding means is over a stack of empty envelopes the holding means can be operated to raise an empty envelope to said path to receive a pushed record while when said holding means is over said stack of filled envelopes, said holding means can be actuated to drop a filled envelope onto said stack.

10. The combination of claim 9 and wherein a support guide means guides said support means for shifting movement transversely of said path, said shifting means being operatively connected with said support means for shifting each stack to and from a position situated beneath said releasable holding means.

11. The combination of claim 9 and wherein said pusher means includes a pusher pin for engaging an end of a record which trails with respect to the direction of movement thereof along said path while pushing the record along said path into an empty envelope held by said releasable holding means, said pusher pin having a lower end region provided with an upwardly directed shoulder which engages the trailing end of each record at a lower surface of each record to support the record simultaneously with the pushing thereof along said path into an envelope.

12. The combination of claim 10 and where said releasable holding means includes a vertically movable suction head having a lower suction means for engaging each envelope and raising the latter from the stack of empty envelopes and for releasing each filled envelope to drop onto the stack of filled envelopes.

13. The combination of claim 12 and wherein each envelope has a lower front edge situated forwardly of an upper front edge thereof and a finger situated in the path of upward movement of the lower front edge of each envelope but not in the path of upward movement of the upper front edge thereof for automatically opening the envelope as it is raised by said releasable holding means.

14. The combination of claim 13 and wherein a blower means is situated adjacent to said releasable holding means for blowing a stream of air into each open envelope to retain latter in an open position for receiving a record.

15. The combination of claim 10 and wherein said position of each stack with respect to said releasable holding means is a first position, said shifting means cooperating with said support means for shifting the stack of filled envelopes to a second position when the stack of empty envelopes is shifted into said first position, and means situated over the filled envelopes at said second position for dropping a separator plate onto the stack of filled envelopes at said second position after each of a given number of filled envelopes have been deposited on the stack of filled envelopes.

16. The combination of claim 15 and wherein said means for dropping the separator plates at said second position includes a suction means situated over said second position for releasably holding a separator plate to be dropped, said support means supporting a stack of separator plates beside the stack of filled envelopes at the side thereof opposite from the stack of empty envelopes, and said shifting means cooperating with said support means for situating the stack of separator plates in said second position when the stack of filled envelopes is shifted into said first position.

17. The combination of claim 16 and wherein a counter means is situated in the path of movement of said pusher means to be actuated thereby for counting each time and pusher means pushes a record into an empty envelope, and said counter means being operatively connected with said suction means for operating same to raise a separator plate from the stack of separator plates at said second position after said given number of filled envelopes have been situated on a previously deposited separator plate, said suction means then dropping the raised separator plate onto the stack of filled envelopes subsequently situated at the second position.

* * * * *